US007592560B1

(12) United States Patent
Lai

(10) Patent No.: US 7,592,560 B1
(45) Date of Patent: Sep. 22, 2009

(54) BUTTON DEVICE

(75) Inventor: Yu-Ping Lai, Foshan (CN)

(73) Assignees: Premier Image Technology(China) Ltd., Foshan, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/166,337

(22) Filed: Jul. 2, 2008

(30) Foreign Application Priority Data

Mar. 7, 2008 (CN) ..... 2008 1 0300495

(51) Int. Cl.
*H01H 13/00* (2006.01)

(52) U.S. Cl. ..... 200/296; 200/341; 200/343

(58) Field of Classification Search ..... 200/5 A, 200/517, 296, 341–345
See application file for complete search history.

(56) References Cited

U.S. PATENT DOCUMENTS 5,552,956 A * 9/1996 Pasquarette et al. ..... 236/94
7,342,192 B2 * 3/2008 Yin et al. ..... 200/296
7,348,511 B2 * 3/2008 Chen et al. ..... 200/296
7,371,984 B2 * 5/2008 Lee et al. ..... 200/296
7,381,919 B1 * 6/2008 Yu et al. ..... 200/296

* cited by examiner

*Primary Examiner*—Michael A Friedhofer
(74) *Attorney, Agent, or Firm*—Zhigang Ma

(57) ABSTRACT

An exemplary button device includes a cover and a push button. The cover includes a main body with an opening defined therein, two spaced blocks, and a post extending from the main body between the blocks. The push button includes a positioning portion with a through hole defined therein for extension of the post, a pressing portion with a key top accommodated in the opening, a connecting portion for connecting the pressing portion to the positioning portion, and two wings stretching from opposite edges of the positioning portion adjacent to the connecting portion into a space between the blocks and the main body respectively. The positioning portion forms a protrusion which resists against the main body and separates the push button from the main body.

9 Claims, 3 Drawing Sheets

BUTTON DEVICE

BACKGROUND

1. Field of the Invention

The present invention relates to switches, and particularly to a button device used as switch in electronic devices.

2. Description of the Related Art

Push buttons are used as input units or switch units in electronic devices, such as mobile phones, remote controllers, cameras, or the like. However, push buttons commonly deflect to one side or another when pressed, preventing a keystroke from being registered.

SUMMARY

An exemplary button device includes a cover and a push button. The cover includes a main body with an opening defined therein, two spaced blocks, and a post extending from the main body between the blocks. The push button includes a positioning portion with a through hole defined therein for extension of the post, a pressing portion with a key top accommodated in the opening, a connecting portion for connecting the pressing portion to the positioning portion, and two wings stretching from opposite edges of the positioning portion adjacent to the connecting portion into a space between the blocks and the main body respectively. The positioning portion forms a protrusion which resists against the main body and separates the push button from the main body.

Other advantages and novel features of the present invention will become more apparent from the following detailed description of exemplary embodiments when taken in conjunction with the accompanying drawings.

DETAILED DESCRIPTION

Figure 1:
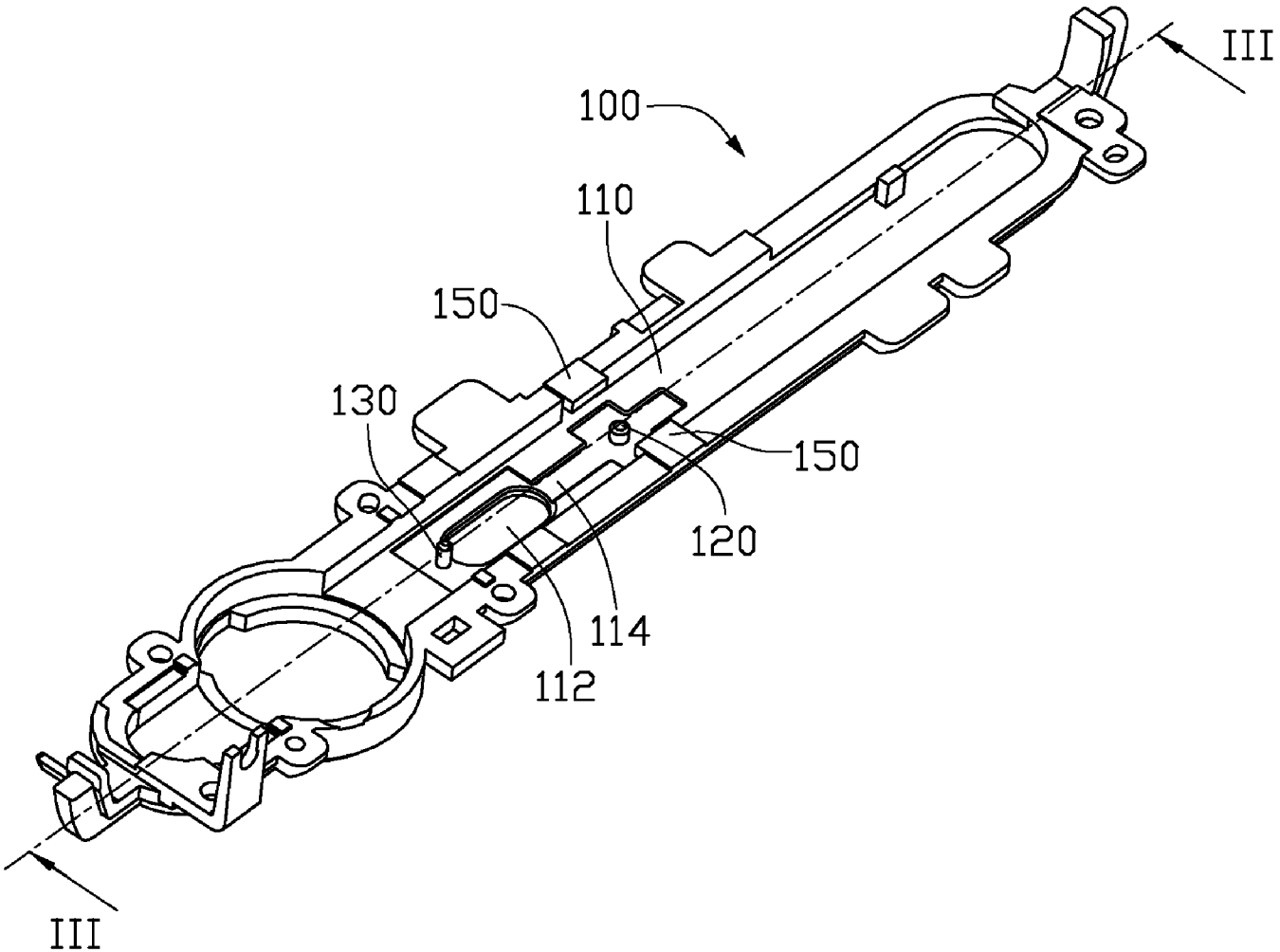
FIG. 1 is an isometric view of an inverted cover of a button device, according to an exemplary embodiment.
Figure 2:
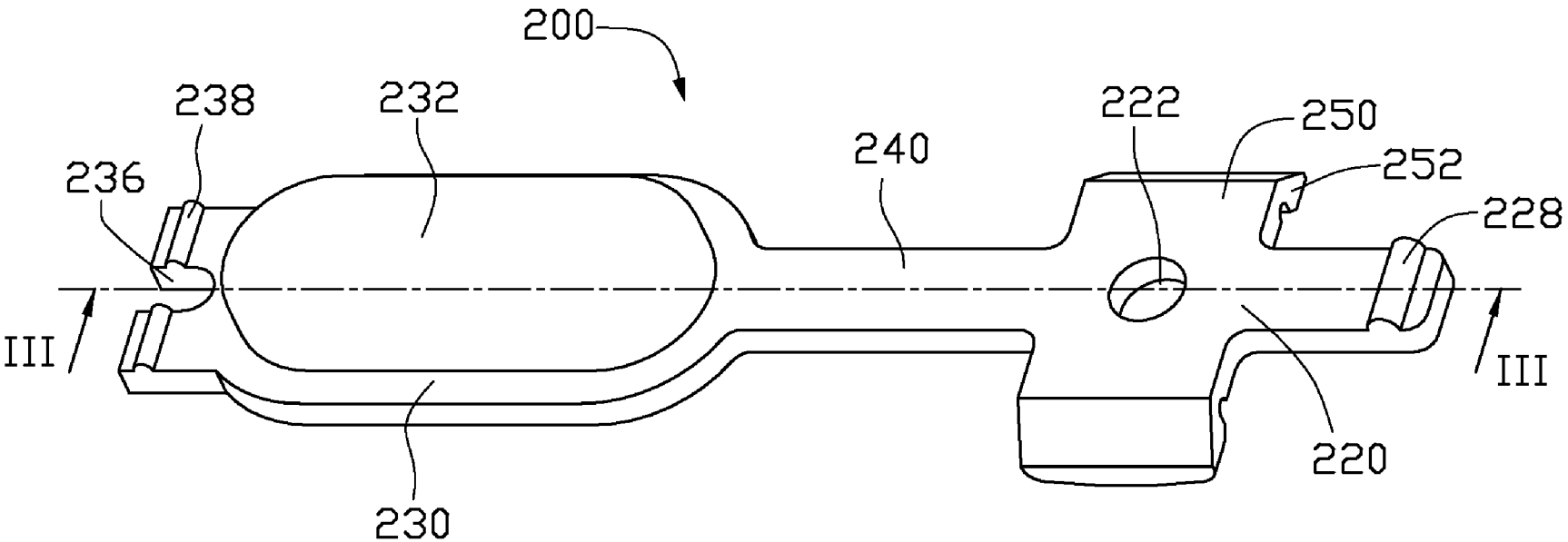
FIG. 2 is an enlarged isometric view of a push button of the button device.
Figure 3:
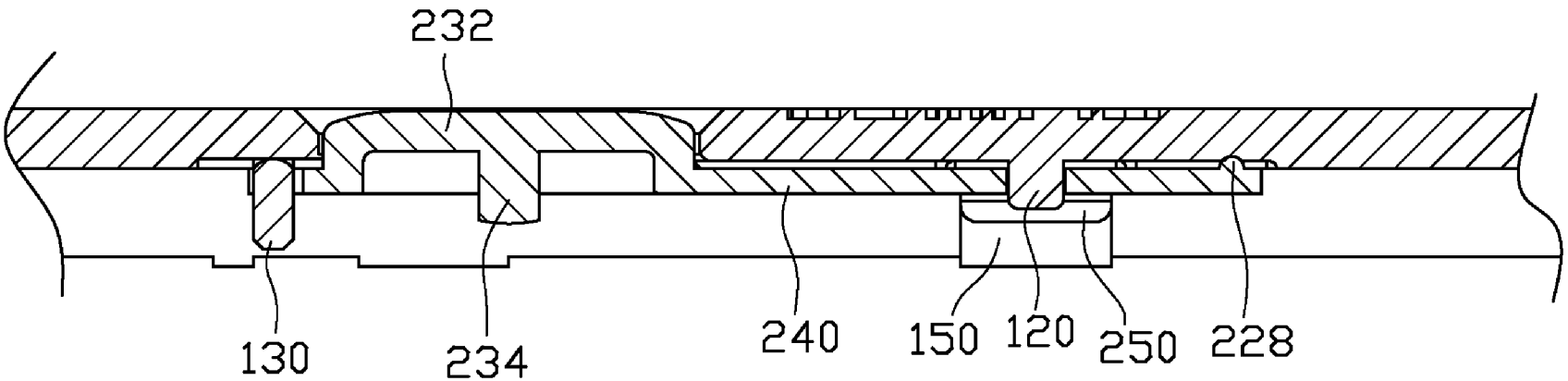
FIG. 3 is a cross-sectional view of an assembly of the button device, taken along lines III-III of FIG. 1 and FIG. 2.

Referring to FIGS. 1 through 3, a button device in accordance with an exemplary embodiment of the present invention includes a cover 100, and a push button 200 positioned on the cover 100. The cover 100 can be a panel of an electronic device (not shown).

The cover 100 comprises a main body 110, two spaced posts 120 and 130 perpendicularly extending from the main body 110, and two spaced blocks 150, adjacent to the two opposite sides of the main body 110 respectively. The post 120 is disposed midway between the blocks 150. The main body 110 defines an opening 112 therein, disposed between the posts 120, 130 but nearer to the post 130. The posts 120 and 130, and the blocks 150 are disposed at an inner side of the cover 100. In the embodiment, the main body 110 forms a recessed portion 114 at the inner side thereof for partially accommodating the push button 200 to minimize dimensions of the button device.

The push button 200 comprises a positioning portion 220, a pressing portion 230, a connecting portion 240 for connecting the pressing portion 230 to the positioning portion 220, and two wings 250 stretching respectively from opposite edges of the positioning portion 220 adjacent to the connecting portion 240.

The positioning portion 220 defines a through hole 222 midway between the wings 250, for extension of the post 120 of the cover 100 therethrough. The positioning portion 220 forms a first protrusion 228, which resists the inner side of the main body 110 and separates the push button 200 from the main body 110 after the push button 200 is assembled to the cover 100. In the embodiment, the first protrusion 228 is a rib.

The pressing portion 230 has a key top 232 formed thereon near the connecting portion 240, and a pressing projection 234 perpendicularly extending from the key top 232 (FIG. 3). The key top 232 is accommodated in the opening 112 of the main body 110, for access by users. The pressing projection 234 is used for pressing a spring (not shown) so that a keystroke may be registered. The pressing portion 230 defines a cutout 236 at an end thereof distant from the connecting portion 240, for extension therethrough of the post 130 of the cover 100. A second protrusion 238 is formed at the end of the pressing portion 230. In this embodiment, the second protrusion 238 is a rib parallel to the first protrusion 228 and is bisected by the cutout 236. The post 130 being in the cutout 238 allows the pressing portion 230 to move like the arm of a lever, and prevents the pressing portion 230 from deflecting to the side and missing the spring. The cutout 236 of the embodiment can be replaced by an elongated hole in other embodiments.

Each of the wings 250 comprises a tilted end 252 outwardly stretched relative to the positioning portion 220. The tilted ends 252 of the wings 250 are positioned to resist against the blocks 150 by sliding the tilted ends 252 into a space between the main body 210 and the blocks 150; therefore, the push button 200 is positioned to the cover 100. The post 120 being in the through hole 222 prevents the positioning portion 220 from being deflected when pressed, after the tilted ends 252 of the wings 250 are mounted in the space between the blocks 150 to connect the push button 200 with the cover 100.

In the embodiment, the push button 200 operates as a lever, and the tilted ends 252 function as a fulcrum of the push button 200. The pressing portion 230 can be depressed to cause a keystroke to be registered. Upon release, the pressing portion 230 is restored to its original location, by means of a force exerted on the first protrusion 224 by the main body 110. The second protrusion 238 prevents the pressing portion 230 from being excessively restored. Therefore, the pressing portion 230 can be more precisely restored.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A button device comprising:

a cover comprising a main body with an opening defined therein, two spaced blocks, and a post extending from the main body between the blocks; and a push button comprising a positioning portion with a through hole defined therein for extension therethrough of the post, a pressing portion with a key top accommodated in the opening, a connecting portion for connecting the pressing portion to the positioning portion, and two wings stretching from opposite edges of the positioning portion adjacent to the connecting portion and capable of being connected to the main body by being mounted between the blocks, the positioning portion forming a protrusion which resists against the main body and separates the push button from the main body.

2. The button device as claimed in claim 1, wherein the post is disposed midway between the wings.

3. The button device as claimed in claim 1, wherein an additional post extends from the main body, and wherein the pressing portion defines a cutout at an end thereof distant from the connecting portion for extension therethrough of the additional post.

4. The button device as claimed in claim 3, wherein the opening is disposed between the posts.

5. The button device as claimed in claim 3, wherein the pressing portion forms a protrusion at an end thereof distant from the connecting portion.

6. The button device as claimed in claim 5, wherein the protrusion of the positioning portion is a rib, and wherein the protrusion of the pressing portion is a rib parallel to the protrusion of the positioning portion.

7. The button device as claimed in claim 5, wherein the protrusion of the pressing portion is a rib bisected by the cutout.

8. The button device as claimed in claim 1, wherein the main body comprises a recessed portion, and wherein the push button is partially accommodated in the recessed portion.

9. The button device as claimed in claim 1, wherein each of the wings comprises a tilted end outwardly stretched relative to the positioning portion and resisting against the blocks respectively.

* * * * *